US008641039B2

(12) United States Patent
Beddoe et al.

(10) Patent No.: US 8,641,039 B2
(45) Date of Patent: Feb. 4, 2014

(54) DOCUMENT HANDLING

(75) Inventors: Andrew Beddoe, Cwmcam (GB); Andrew Holmes, Worcester (GB); Andrew Denley, Coventry (GB)

(73) Assignees: Intelligent Deposit Systems Ltd., Gwent (GB); Volumatic Ltd., Coventry (GB)

( * ) Notice: Subject to any disclaimer, the term of this patent is extended or adjusted under 35 U.S.C. 154(b) by 714 days.

(21) Appl. No.: 12/918,370

(22) PCT Filed: Mar. 2, 2009

(86) PCT No.: PCT/GB2009/000573

§ 371 (c)(1),
(2), (4) Date: Aug. 19, 2010

(87) PCT Pub. No.: WO2009/106856

PCT Pub. Date: Sep. 3, 2009

(65) Prior Publication Data

US 2011/0007358 A1 Jan. 13, 2011

(30) Foreign Application Priority Data

Feb. 28, 2008 (GB) ..... 0803671.7

(51) Int. Cl.
*B65H 29/46* (2006.01)

(52) U.S. Cl.
USPC ..... 271/180

(58) Field of Classification Search
USPC ..... 271/117, 180, 181, 188, 209, 220
See application file for complete search history.

(56) References Cited

U.S. PATENT DOCUMENTS

| | | | | |
|---|---|---|---|---|
| 4,050,562 | A | 9/1977 | Schwippert et al. | |
| 5,064,074 | A | 11/1991 | Edin et al. | |
| 5,735,516 | A | 4/1998 | Gerlier et al. | |
| 5,826,680 | A | 10/1998 | Takemoto | |
| 5,975,273 | A | 11/1999 | Zwahlen et al. | |
| 6,244,589 | B1 * | 6/2001 | Gerlier | 271/177 |
| 6,398,000 | B1 * | 6/2002 | Jenrick et al. | 194/200 |
| 6,659,452 | B2 * | 12/2003 | Abe et al. | 271/181 |
| 6,966,555 | B2 * | 11/2005 | Cost et al. | 271/180 |

(Continued)

FOREIGN PATENT DOCUMENTS

| | | | |
|---|---|---|---|
| EP | 0604880 | A | 7/1994 |
| EP | 0751487 | A | 1/1997 |

(Continued)

OTHER PUBLICATIONS

British Search Report for corresponding British Application No. GB0803671.7, dated May 9, 2008.

(Continued)

*Primary Examiner* — Jeremy R Severson
(74) *Attorney, Agent, or Firm* — Caesar, Rivise, Bernstein, Cohen & Pokotilow, Ltd.

(57) ABSTRACT

Apparatus for handling documents comprises an inlet 30 for receiving documents, a transfer means for transferring documents from the inlet to a secure or securable location and deposit means, wherein the transfer means is operable, in use, to transfer documents between the inlet and a deposit position adjacent the securable location, said deposit means comprises a plunger 50 and movable members 523*b*, 523*c* wherein the movable members 523*b*, 523*c* are arranged to move along the plunger 50 as the plunger 50 urges documents into the securable location.

12 Claims, 15 Drawing Sheets

(56) References Cited

U.S. PATENT DOCUMENTS

| | | | | |
|---|---|---|---|---|
| 7,172,193 | B2 * | 2/2007 | Cost et al. | 271/180 |
| 2003/0127791 | A1 * | 7/2003 | Cost et al. | 271/180 |
| 2003/0180131 | A1 | 9/2003 | Lewis | |
| 2004/0007624 | A1 | 1/2004 | Ogawa et al. | |
| 2004/0033832 | A1 | 2/2004 | Solomon | |
| 2006/0210137 | A1 * | 9/2006 | Raterman et al. | 382/135 |
| 2007/0095692 | A1 * | 5/2007 | Apps | 206/386 |
| 2007/0125841 | A1 | 6/2007 | Franks, Jr. | |

FOREIGN PATENT DOCUMENTS

| | | |
|---|---|---|
| EP | 0967165 | 12/1999 |
| EP | 1022695 | 1/2000 |
| EP | 1323655 A | 7/2003 |
| EP | 1323656 | 7/2003 |
| EP | 1460590 | 3/2004 |
| GB | 1535706 | 12/1978 |
| GB | 1539673 | 1/1979 |
| GB | 2364591 | 1/2002 |
| WO | 01/59723 | 8/2001 |
| WO | 2005/098767 | 10/2005 |
| WO | 2006/077423 | 7/2006 |

OTHER PUBLICATIONS

British Search Report for corresponding British Application No. GB0803671.7, dated Jan. 15, 2009.

British Search Report for corresponding British Application No. GB0803671.7, dated Jan. 19, 2009.

International Search Report for PCT/GB2009/000573.

* cited by examiner

DOCUMENT HANDLING

CROSS-REFERENCE TO RELATED APPLICATIONS

This application is a national stage application that claims the benefit under 35 U.S.C. §371 of International Application No. PCT/GB2009/000573 filed on Mar. 2, 2009, which in turn claims priority to British Application No. 0803671.7 filed on Feb. 28, 2008.

BACKGROUND OF THE INVENTION

The present invention relates generally to apparatus for handling documents, such as currency, for example bank notes. More specifically, although not exclusively, the present invention relates to an apparatus for accurately and securely counting and transferring currency from one location to another.

Businesses such as retail vendors, casinos and the like are burdened with the laborious task of counting and handling money taken through their activities. The costs associated with this task are significant owing to the labour required to reconcile, transport, handle and bank or deposit the funds. Whilst it is not common, businesses also face the possibility that staff or other persons will steal handled money.

For example, casinos offer a wide selection of table games, such as Blackjack, Roulette and Poker, and will generally allow players to pay in cash at the table. In such instances the table will generally include a drop box, which usually consists of a metal box fastened to the underside of the table and may include a removable secure inner cash sleeve. The cash is first counted by the casino employee, e.g. the dealer, the amount is agreed with the client, e.g. the player, and then the cash is inserted into the drop box.

Casinos in the UK generally transfer all cash drop boxes from their gaming tables to the vault at the time of closing. The funds are meticulously counted twice by a number of individuals to ensure an accurate count. This process generally takes 3 to 6 hours and requires strict security measures.

Similarly, all businesses which are required to handle physical funds provided by customers must carry out such laborious and costly tasks to some extent.

It is a peculiarity of casinos that it is in some states necessary for the money handed to the casino (e.g. the croupier) to be visible and accessible to a player or punter before it is deposited and a transaction completed.

Accordingly, there is a need for an apparatus which facilitates and/or simplifies such handling tasks. It is therefore a non-exclusive object of the invention to provide an apparatus for handling valuable documents such as currency which helps to simplify the aforementioned process and/or at least partially mitigate the aforementioned issues.

SUMMARY OF THE INVENTION

A first aspect of the invention provides an apparatus for handling documents comprising an inlet for receiving documents, a transfer means for transferring documents from the inlet to a secure or securable location and deposit means, wherein the transfer means is operable, in use, to transfer documents between the inlet and a deposit position adjacent the securable location, said deposit means comprising a plunger and movable members wherein the movable members are arranged to move along the plunger as the plunger urges documents into the securable location.

A second aspect of the invention provides an apparatus for handling documents comprising an inlet for receiving documents and a transfer means for transferring documents from the inlet to a secure or securable location, wherein the transfer means is operable, in use, to transfer documents between the inlet and a deposit position adjacent the securable location, and deposit means, for urging, in use, documents located at the deposit position into the secure or securable location, said deposit means comprising one or more extendable portions arranged to move between an extended and a contracted position as said deposit means urges documents into the secure or securable location.

A further aspect of the invention provides apparatus for handling documents comprising an inlet for receiving documents and transfer means for transferring documents from the inlet to a securable container, wherein the transfer means is operable, in use, to transfer documents between the inlet, an intermediate or escrow position for providing restricted access to the documents, and a deposit position adjacent the securable container.

The transfer means may further comprise a movable container for holding the documents. The transfer means may further comprise depositing means, e.g. a plunger for depositing, e.g. urging, in use, documents into the securable container, for example from the or a deposit or drop position through an inlet of the securable container. The plunger may comprise one or more extendable portions, for example which increase a surface area of the plunger, preferably the surface area which contacts the documents in use.

A third aspect of the invention provides a plunger for urging, in use, documents into a securable container, wherein the plunger includes one or more extendable portions which are extendable, in use, to increase the effective area of the plunger.

The extendable portions may be movable relative to the plunger between a stowed position and an extended condition. The extendable portions preferably comprise wipers and/or cooperate, in use, with a portion of the movable container to catch and/or urge documents contained in the movable container through an outlet thereof.

The apparatus may further comprise scanning means, e.g. a counter, for example which scans, in use, documents received at or adjacent the inlet.

In a further aspect, the invention provides a movable container for transferring documents between a loading position, and intermediate or escrow position and a loading position within an apparatus described herein, the container comprising one or more movable portions, for example hinged portions, at the base thereof to provide a closable outlet The movable container may have an inlet that communicates, in use, with the inlet of the apparatus or the outlet of the scanning means. The movable container may also have an outlet which communicates, in use, with the or an inlet of the secure container. One of the walls of the container may comprise recesses to allow passage of document delivery fingers, the part between the recesses providing document stop means to disengage documents from the document delivery fingers.

The movable container may comprise two or more movable portions, for example two separate base portions which may be hinged to opposed side walls of the movable container. Preferably, the movable container has an open top, for example to provide the inlet of thereof, with one or more side walls and a base, which base may include at least one movable portion, which may be hinged, to move with respect to the or a side wall. More preferably, the base includes two hinged portions, for example wherein one is hinged to a lower edge of each of two opposed side walls. The or each hinged portion may be biased to a closed or retracted position at an angle, such as at right angles, to the side wall.

The one or more extendable portions may comprise one or more contact means, e.g. plates, for example wiper blades or other members, which may include one or more contact members and/or may be movable relative to the plunger such as in a scissor arrangement. The extendable portions and/or plates and/or blades and/or contact members may be biased, for example biased at or towards the or an extended position.

The cooperating portion of the movable container may comprise a portion of one or more side walls and/or the or a movable portion of the base. Preferably, the cooperating portion of the movable container comprises guide means, for example grooves and/or ridges, which may be on an internal surface of the movable container.

The or each extendable portion may comprise a cooperating portion, for example a protruding portion or contact member, which cooperates, in use, with the guide means. Preferably, the or each extendable portion cooperates, in use, with the guide means such that relative movement between the plunger and the movable container causes the or each extendable portion to move, for example rotate, relative to the plunger. More preferably, the or each extendable portion cooperates, in use, with the guide means such that movement of the plunger relative to the movable container, for example through the outlet, causes the or each extendable portion to move from a first position, e.g. the or an extended position, toward a second position, e.g. the or a stowed position.

The transfer means may further comprise alignment means for aligning the documents received at the inlet, for example by gravity. The alignment means may comprise a transfer wheel, which may be cylindrical in shape, for example to receive and transfer documents or currency to the movable container. The transfer wheel may comprise a plurality of receiving members, which may extend in a substantially tangential direction of the transfer wheel. The movable container may comprise one or more co-operable members such as recesses, for example in a side wall thereof, for receiving the documents from the transfer wheel. The movable container may be tilted, for example orientated such that its base is at an angle with the horizontal, to aid alignment of the documents, in use. The side wall of the movable container may be orientated to receive and align the documents transferred from the transfer wheel.

The apparatus may comprise a transparent or translucent portion for viewing documents contained in the transfer means, for example when it is in the intermediate or escrow position. The apparatus may also comprise access means, for example to permit access, such as restricted access, in use, to documents in the intermediate or escrow position. The access means may comprise a locked or lockable door and/or latching mechanism. In one embodiment, the access means comprises the or a transparent or translucent portion for viewing the documents contained in the transfer means.

The apparatus may comprise a display means, which may be arranged to display the value of the counted documents.

The apparatus may comprise transmission means for transmitting, in use, information to a remote terminal. The transmission means may be wireless transmission means.

The apparatus may further comprise a securable container, which may be a secureable pouch, for example having tamper evidence means.

A further aspect of the invention provides a table comprising the apparatus described above.

The table may comprise an aperture in which the apparatus is located. Preferably, the apparatus is located such that an upper surface thereof is substantially contiguous with a work surface of the table.

A further aspect of the invention provides a system for monitoring one or more of the apparatus described above, the system comprising a remote terminal arranged to receive information from the one or more apparatus.

Preferably, the system comprises one or more of the apparatus. More preferably, the system comprises one or more tables comprising the apparatus.

A yet further aspect of the invention provides a method of receiving documents, the method comprising passing documents through an inlet in a housing, transferring the documents to an intermediate or escrow position which provides restricted access to the documents and depositing the documents in a secure or securable container within the housing.

Another aspect of the invention provides a method of transferring documents into a securable container, the method comprising increasing the effective area of a plunger using extendable portions and urging the documents into the securable container using the increased effective area of the plunger.

The extendable portions preferably cooperate, in use, with a portion of a container to catch and/or urge documents contained in the container through an outlet thereof.

The method may further comprise the step of logging information related to the receipt and/or quantity and/or value of the documents during or after the the documents are deposited in the secure location or container. This information may be transmitted to a remote terminal and/or displayed, such as by attaching the information to the secure location or container.

A yet further aspect of the invention provides apparatus for handling documents comprising an inlet, document assessment means and transfer means to transfer received documents to a secure or securable location, wherein said transfer means comprises a movable container having a base and side walls for receiving documents from the document assessment means, the movable container being movable from a first document receipt position wherein the base of the container is at an angle to the horizontal to a second document deposit position wherein the base of the container is horizontal, the container being movable between first and second positions along a guide path having a first inclined position adjacent the document receipt position and a second horizontal position above said first position and adjacent said second document deposit position.

The documents may comprise currency, for example bank notes.

BRIEF DESCRIPTION OF SEVERAL VIEWS OF THE DRAWINGS

One embodiment of the invention will now be described, by way of example only, with reference to the accompanying drawings in which.

DETAILED DESCRIPTION OF PREFERRED EMBODIMENTS

Figure 1:
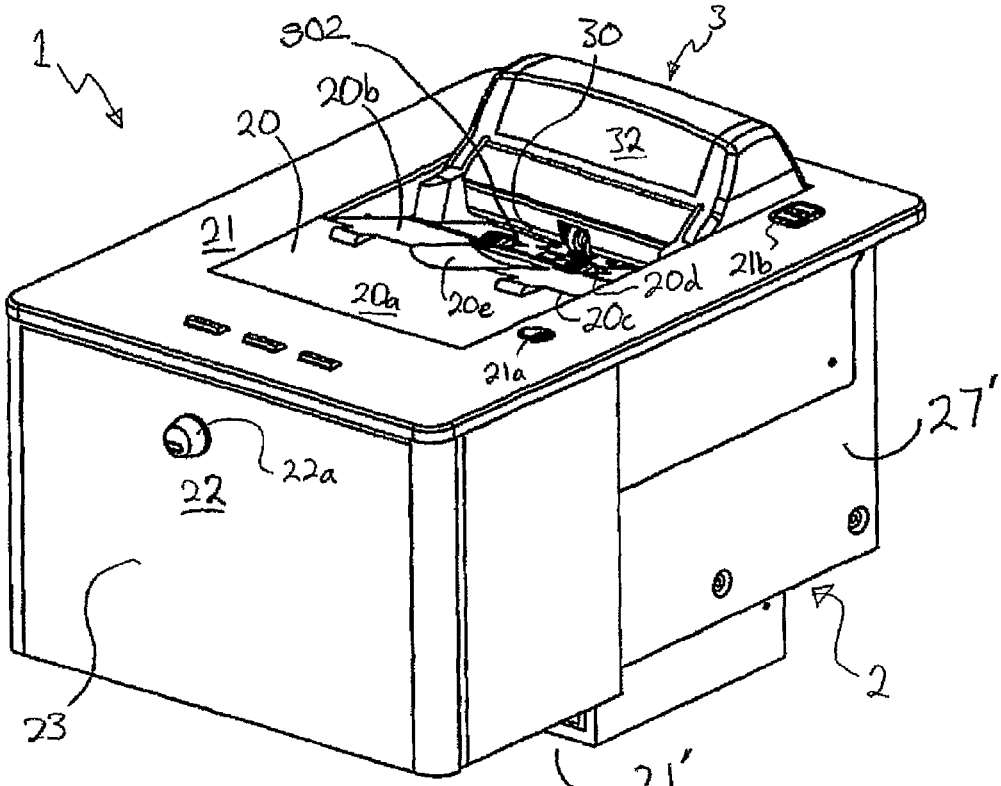
FIG. 1 is a perspective view of an apparatus according to the invention.

Referring to FIGS. 1 to 3C, there is shown an apparatus 1 for handling currency which includes a housing 2, a counter 3, a movable container 4, a plunger mechanism 5 and a securable container 6. The securable container 6 in this embodiment incorporates a tamper evident enclosure for the storage and transport of bank notes similar to that which is disclosed in WO 02/19289 and/or WO 2008/114038, the entire contents of which are incorporated herein by reference.

The housing 2 is generally rectangular in plan having a top 21 and bottom 21', a front wall 23 a rear wall 23' and side walls 27, 27'. A first access door 20 is provided in the top 21 thereof, a second access door 22 is provided in, or forms at least a part of, the front wall 23 thereof and a third access door 27*a* is provided in one of the side walls 27, 27'. The top 21 includes an acceptance push button 21*a* and an rejection push button 21*b* for selectively releasing the counted currency, more of which later. The first access door 20 is transparent and extends across a portion of the top 21 with a flat portion 20*a*, which is substantially aligned with the top 21, and a ramp portion 20*b*, which extends downwardly from the flat portion 20*a* towards the rear wall 23 of the housing 2. The ramp portion 20*b* includes an uppermost edge 20*c*, a lowermost edge 20*d* and a central depression 20*e* extending from the uppermost edge 20*c* toward the lowermost edge 20*d*. The second access door 22 forms the end wall 23 of the housing 2 and includes a key lock mechanism 22*a* for releasably locking the second access door 22 in a closed position.

Figure 2:
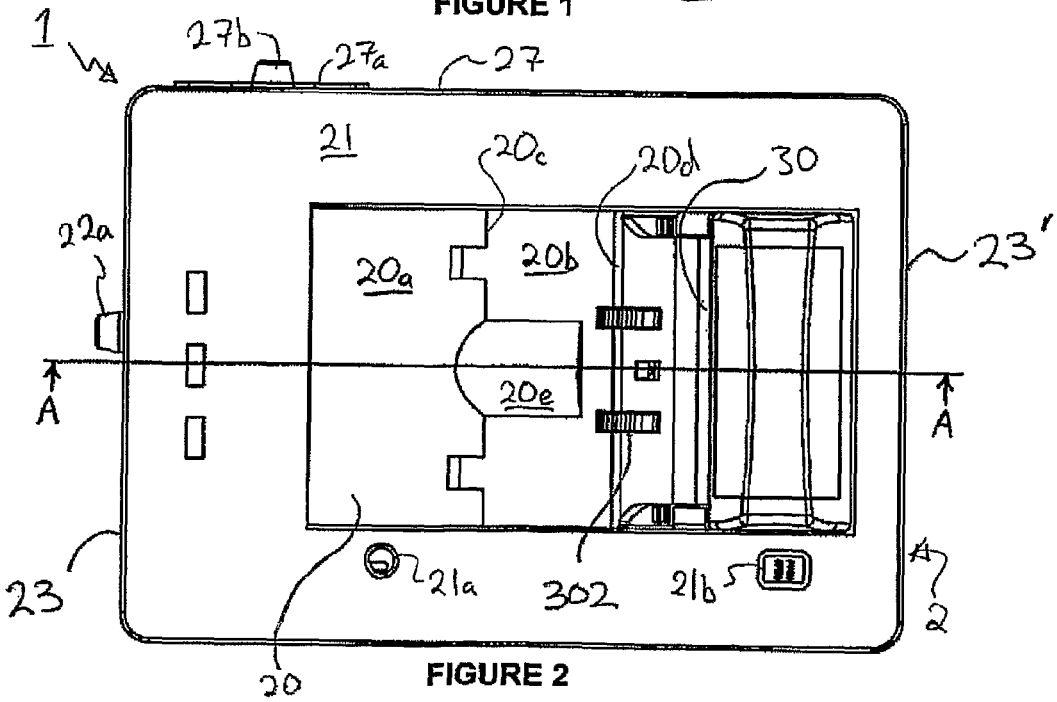
FIG. 2 is a top view of the apparatus of FIG. 1.
Figure 2A:
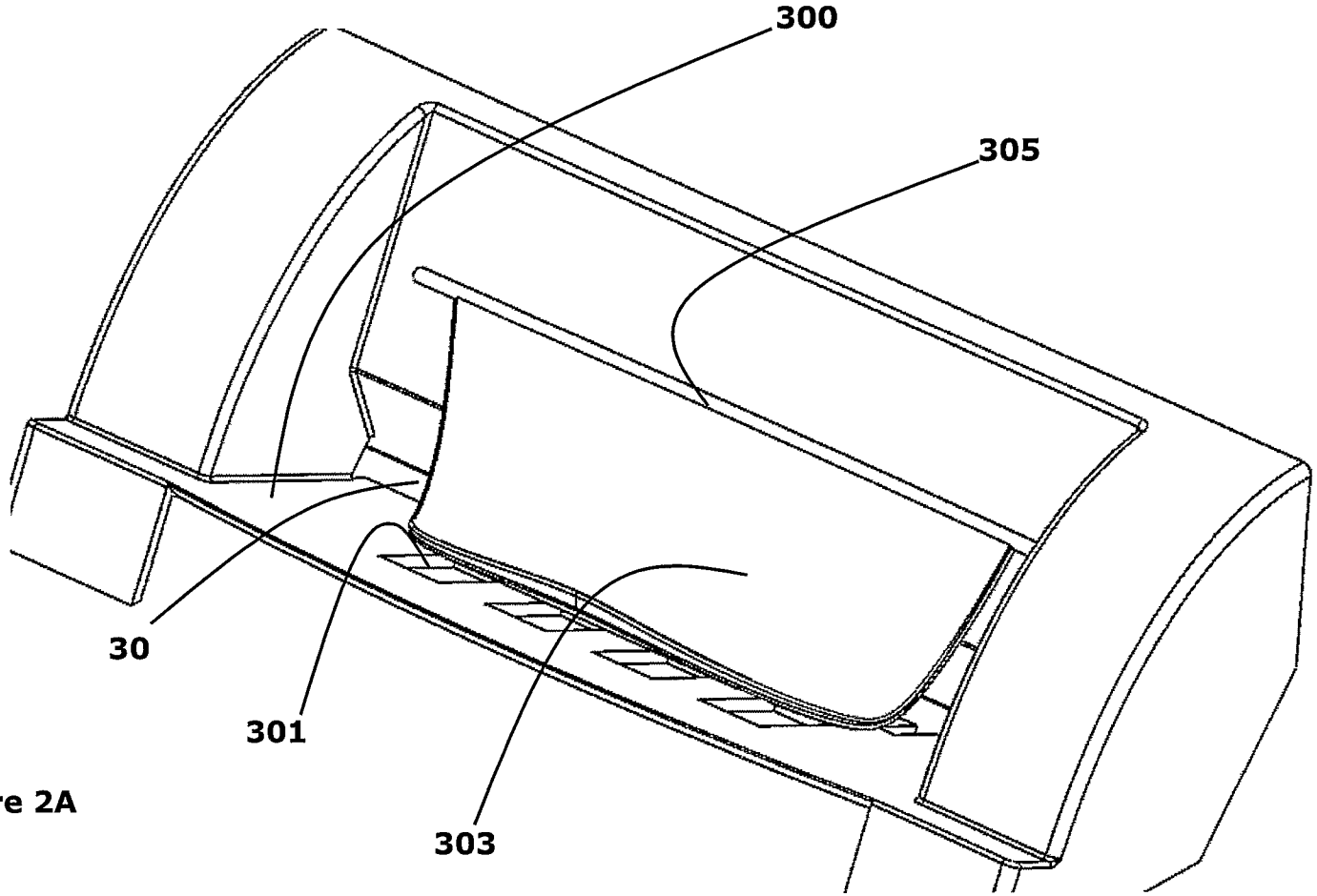
FIG. 2A is a perspective view of an apparatus inlet.

FIG. 2A shows a possible document inlet configuration having a document tray 300 for receiving documents, the tray having a plurality of apertures 301 through which friction wheels 302 protrude to engage documents held in the tray 300 and force them into the inlet 30. There is further provided a pivotable weight 303 comprising a curved weighted body 304 pivotably mounted 305 to the apparatus. In use, the weight 303 is lifted to allow one of more documents to be placed on the tray 300 and the weight lowered on to the top most document in the stack. The weight 303 ensures that the documents are engaged by the friction wheels 302 to encourage proper feeding of documents to the inlet 30. The underside of the weight 303 is smooth so as to flatten crumpled or creased documents as they are drawn passed the leading edge of the weight 303 by the wheels 302.

Figure 3A:
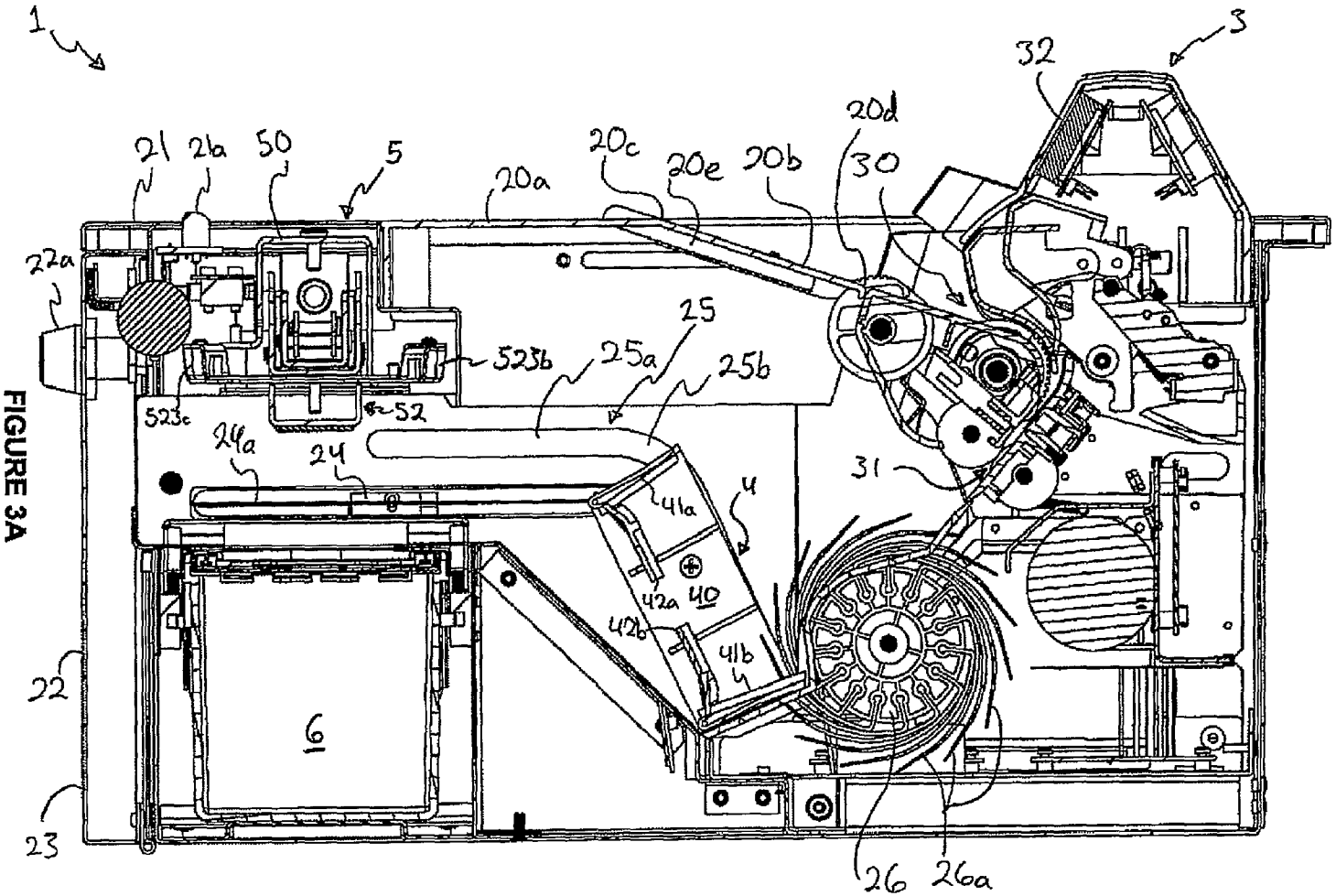
FIG. 3A is a section view along line A-A of FIG. 2 showing the movable container in a first, documents receiving position.

Referring to FIGS. 3A, B, C, located within the housing 2 is a conveyor 24 and guide slot 25. The conveyor 24 includes a cable 24*a*, or other reciprocable drive means, to which is attached a carrier 24*b* (shown in FIG. 10) and a motor (not shown) which drives the cable 24*a*. The guide slot 25 includes first and second straight portions 25*a* and 25*c* interconnected by a curved portion 25*b*. The first straight portion 25*a* is located above and is parallel to the conveyor 24 and the second straight portion 25*c* extends downwardly and at an angle thereto to an end stop 25*d*.

The third access door 27*a* includes a key lock mechanism 27*b* for releasably locking the third access door 27 in a closed position.

The counter 3 is a cash counter in this embodiment which includes an inlet 30, an outlet 31 and a display screen 32 which protrudes upwardly from the top 21 of the housing 2. The counter 3 is mounted to the housing 2 such that the inlet 30 of the counter 3 is located adjacent the lowermost edge 20*d* of the ramp portion 20*b* to facilitate document loading into the counter 3. The outlet 31 of the counter 3 faces the inside of the housing 2 and feeds into a transfer wheel 26 having a pair of arrays of a plurality of finger members 26*a* which extend radially therefrom and are bent to provide a distal tangential portion. Currency fed through the counter 3 exits through the outlet 31 into gaps between adjacent finger members 26*a* on the transfer wheel 26.

Figure 4A:
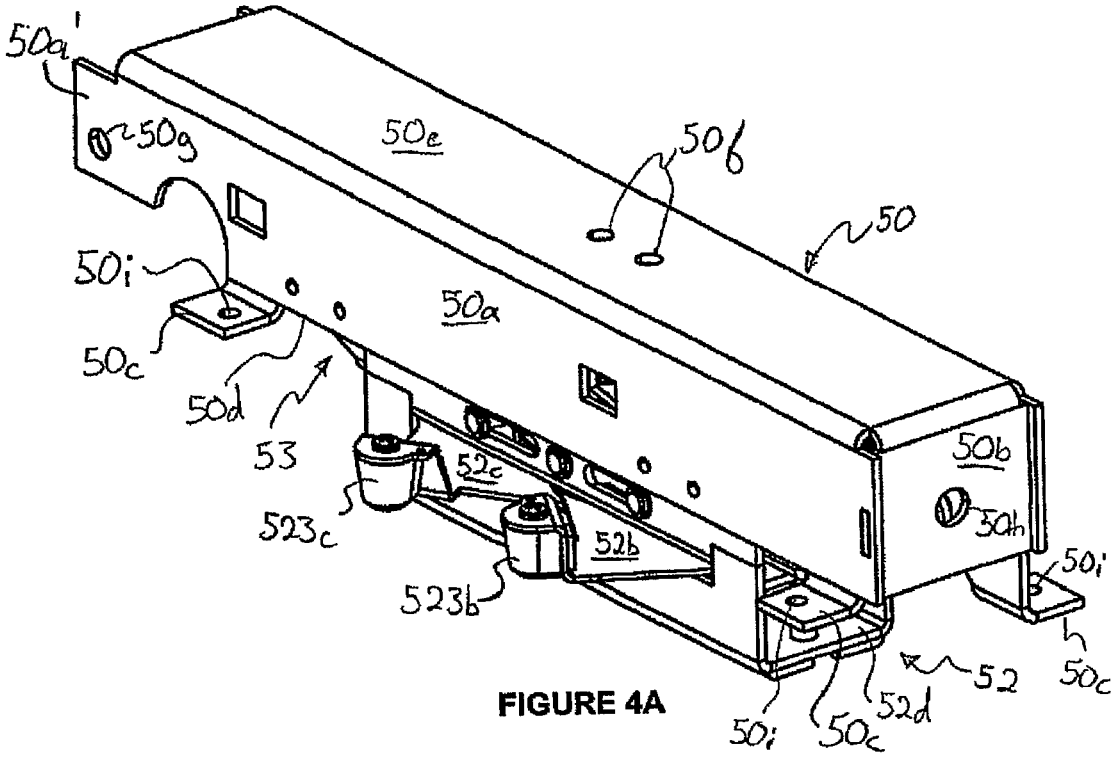
FIG. 4A is a perspective view of the plunger mechanism of the apparatus of FIG. 1 in a retracted position.
Figure 4B:
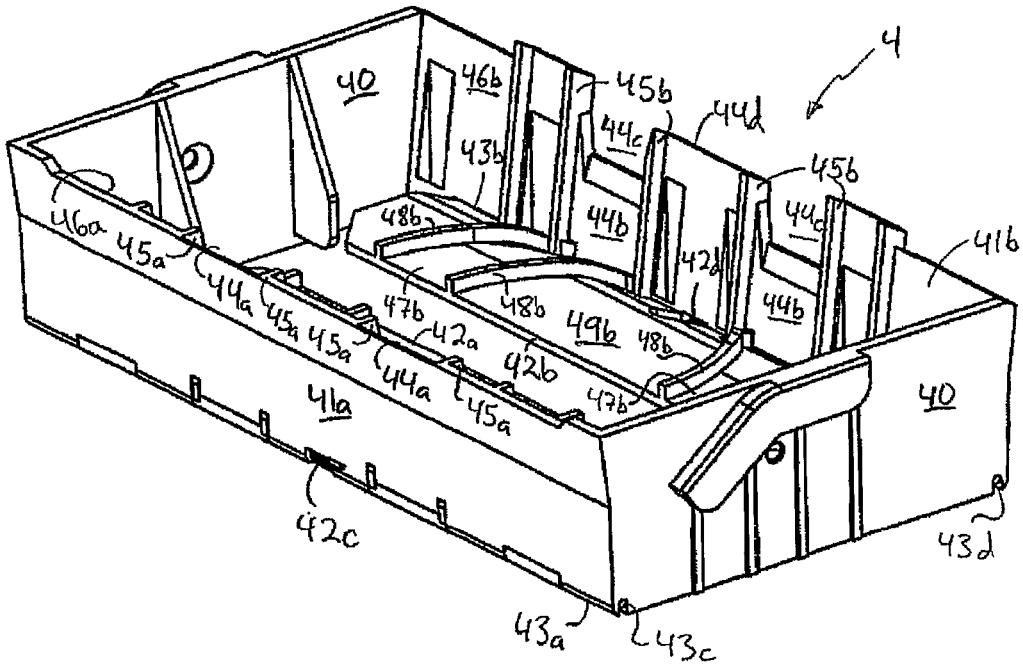
FIG. 4B is a perspective view of the movable container of the apparatus of FIG. 1 with the base thereof in a retracted position.
Figure 5A:
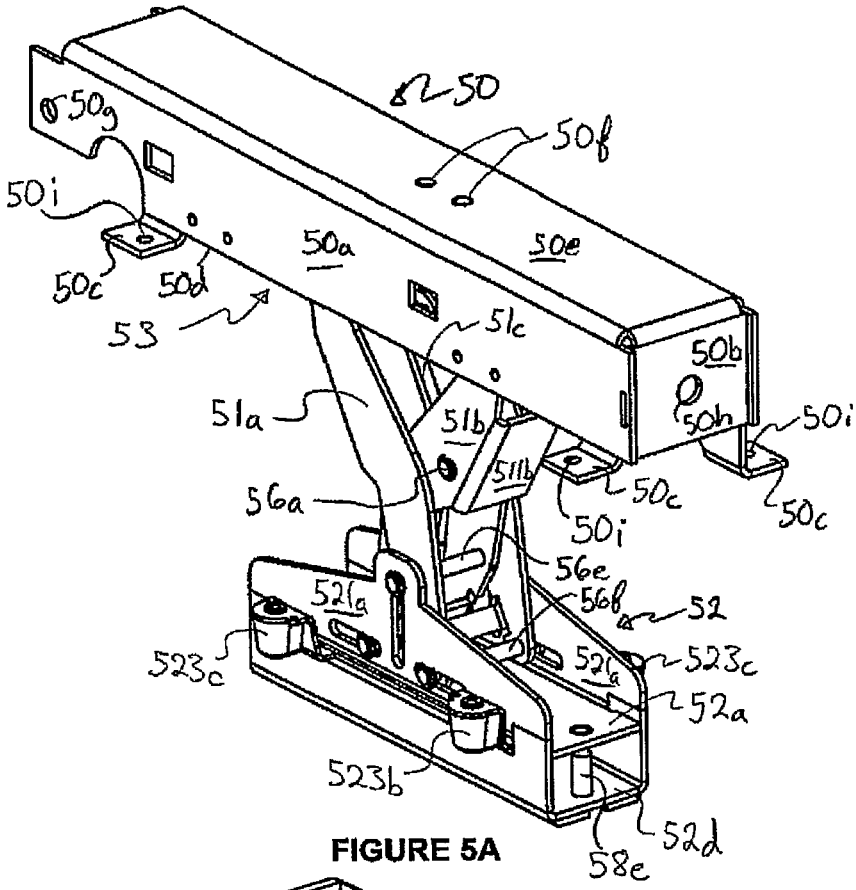
FIG. 5A is a view similar to FIG. 4A with the plunger in a fully extended position.
Figure 5B:
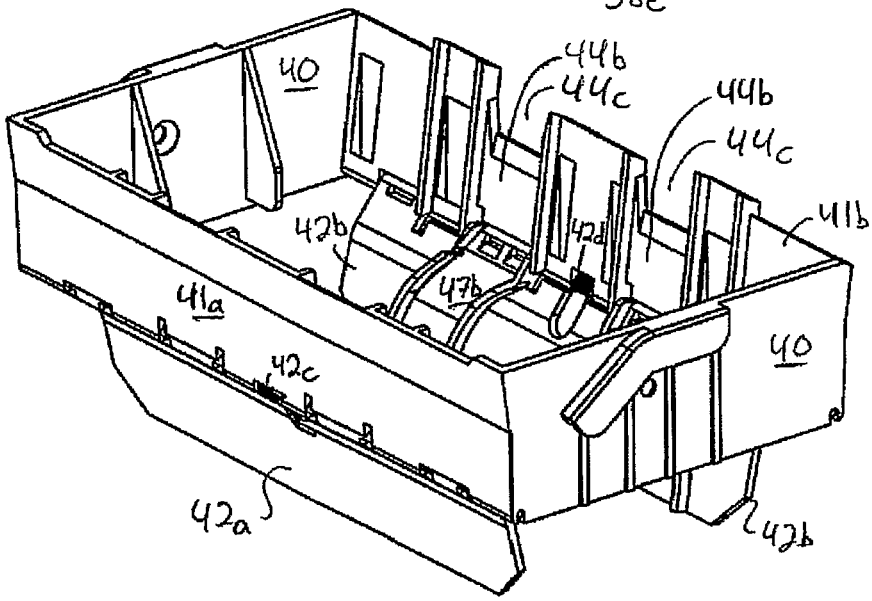
FIG. 5B is a view similar to FIG. 4B with the base of the movable container in a fully extended position.
Figure 10:
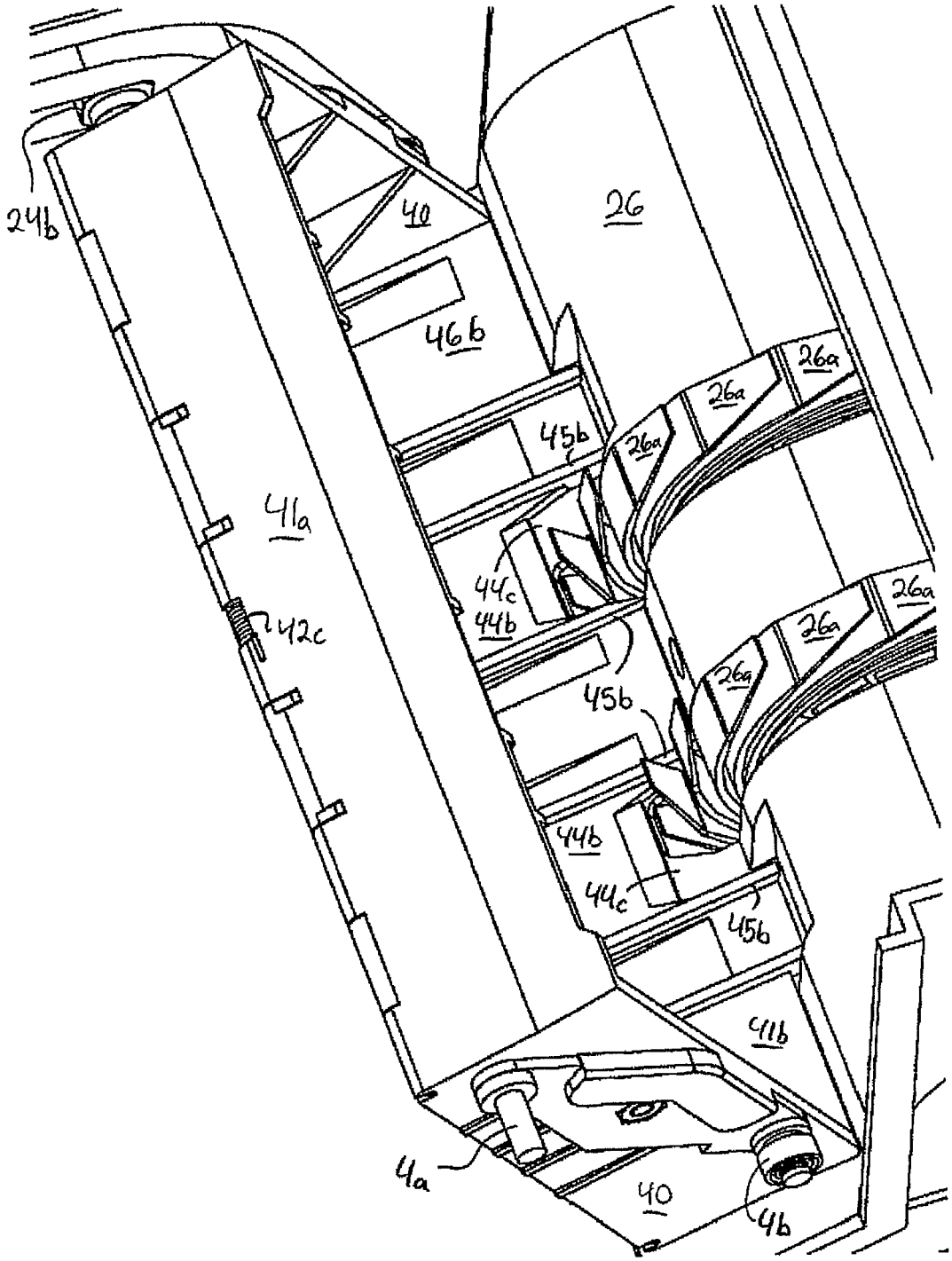
FIG. 10 is a partial perspective view illustrating the interaction between the transfer wheel and the movable container.

As shown more clearly in FIG. 4B, 5B & 10, the movable container 4 is substantially rectangular in plan with end walls 40, upwardly diverging side walls 41*a*, 41*b* and base flaps 42*a*, 42*b*. Each side wall 41*a*, 41*b* includes a lowermost edge 43*a*, 43*b* and pair of vertically extending guide channels 44*a*, 44*b* formed by opposed ridges 45*a*, 45*b* on an internal surface 46*a*, 46*b* thereof. One of the side walls 41*b* includes a pair of recesses 44*c* in its uppermost edge 44*d* which are aligned with the guide channels 44*b*. Each base flap 42*a*, 42*b* is connected to the lowermost edge 43*a*, 43*b* of one of the side walls 41*a*, 41*b* by a respective hinge 43*c*, 43*d* and includes a pair of curved guide channels 47*a*, 47*b* formed by opposed ridges 48*a*, 48*b* on an internal surface 49*a*, 49*b* thereof. The base flap channels 47*a*, 47*b* are aligned with the side wall channels 44*a*, 44*b* adjacent the hinge 43*c*, 43*d* and diverge toward the free edge of the base flap 42*a*, 42*b*. The base flaps 42*a*, 42*b* are biased by a spring mechanism 42*c*, 42*d* to a closed position where they are substantially horizontal and extend inwardly of the movable container 4.

The movable container 4 is mounted within the housing 2 such that its end walls 40 are connected adjacent the front side wall 41*a* by a connector pin 4*a* to the conveyor carrier 24*b* and a guide member 4*b* is received within the guide slot 25. Thus, the movable container 4 is movable between a loading position (shown in FIG. 3A), an intermediate or escrow position (shown in FIG. 3B) and a deposit or drop position (shown in FIG. 3C).

In the loading position, the guide member 4*b* abuts the end stop 25*d* of the guide slot 25, the movable container 4 has been carried by the conveyor 24 to the rearmost point of its travel and the movable container 4 is inclined so that the recesses 44*c* in the uppermost edge 44*d* of the side wall 41*b* are able to communicate with the finger members 26*a* of the transfer wheel 26 (see FIG. 10).

In the intermediate or escrow position, the guide member 4*b* is within the curved portion 25*b* of the guide slot 25, the conveyor 24 has carried the movable container 4 to an intermediate position and the movable container 4 is substantially horizontal and located beneath the transparent first access door 20.

In the escrow position, the movable container 4 may be engaged by a mechanism (not shown) to lift it through the door 20. Such mechanism may incorporate a scissor lift, actuator or other electrically, hydraulically, pneumatically actuated lift device. Alternatively, the mechanism may engage with the flaps 42*a*, 42*b* of the container 4 to move them out of the way and then lift the documents clear of the housing or access by the customer.

In the drop position, the guide member 4*b* is at the front end of the first straight portion 25*a* of the guide slot 25, the conveyor 24 has carried the movable container 4 to the fully forward position and the movable container 4 is substantially horizontal and located between the plunger mechanism 5 and the securable container 6.

The plunger mechanism 5, shown more clearly in FIGS. 4A, 5A and 6A and 6B, includes a mounting member 50, a first scissor member 51*a*, a second scissor member 51*b*, an intermediate scissor member 51*c*, a plunger assembly 52 and an actuator mechanism 53.

The mounting member 50 is a substantially rectangular box 50 with two longitudinal side walls 50*a*, an end wall 50*b* and four L-shaped brackets 50*c* (only three of which are shown) extending from the lower edge 50*d* thereof, two proximate the end wall 50*b* and two towards the other end of the box 50, all four extending orthogonally from the side walls 50*a*, two associated with each side wall 50*a*. The box 50 also having a top wall 50*e*. The mounting member 50 is formed of sheet material and includes a pair of holes 50*f* through the top wall 50*e*, a mounting hole 50*g* through one of the side walls 50*a* adjacent the open end (i.e. the opposite end to the end wall 50*b*), and extending beyond the top wall 50*e* to form a tongue 50*a*', mirrored by the other side wall 50*a*, a further hole 50*h* through the end wall 50*b* and a fixing hole 50*i* through the foot of each of the brackets 50*c*.

Figure 6A:
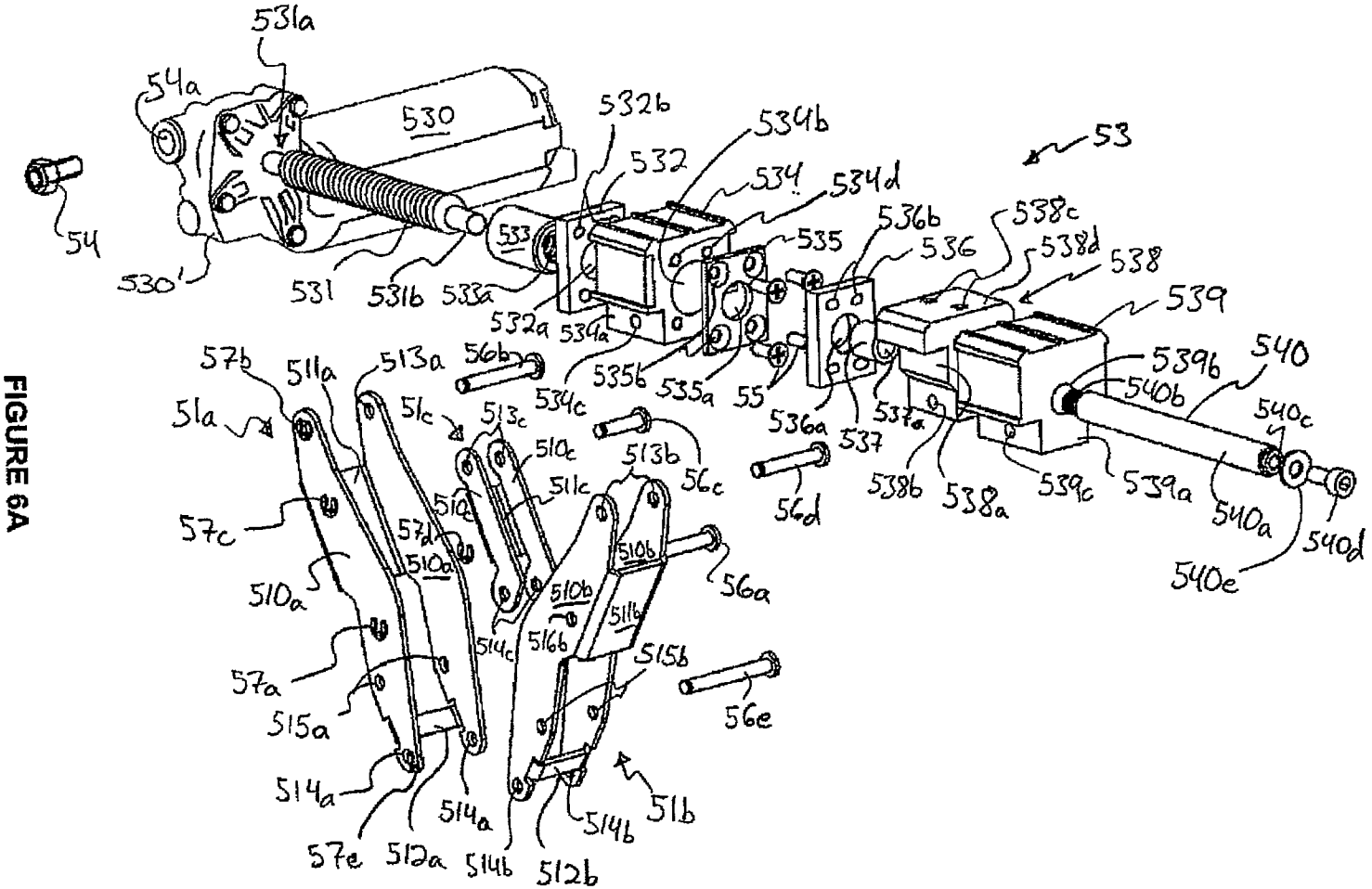
FIG. 6A is an exploded perspective view of the actuator mechanism and scissor members of the plunger mechanism shown in FIGS. 4A and 5A.

As shown in FIG. 6A, the actuator mechanism 53 includes an electric motor 530, an externally threaded shaft 531, a first bush retaining plate 532, a threaded bush 533, a first moving block 534, a second bush retaining plate 535, a third bush retaining plate 536, a second bush 537, a stationary block 538, a second moving block 539 and a guide shaft 540. The externally threaded shaft is coupled to the rotor (not shown) of the electric motor 530 at one end 531*a* thereof and the other end 531*b* thereof is smooth and free of threads. Each of the first, second and third bush retaining plates 532, 535, 536 is rectangular in plan and has a respective central hole 532*a*, 535*a*, 536*a* and four respective fixing holes 532*b*, 535*b*, 536*b* through its thickness. The threaded bush 533 is cylindrical in shape with a threaded hole 533*a* through its thickness along the principal axis thereof. The outside diameter of the threaded bush 533 is larger than the central hole 532*a* in the first bush retaining plate 532 and the central hole 535*a* in the second bush retaining plate 535. The first moving block 534 is substantially rectangular in plan with an undersized lower portion 534*a* and includes a central hole 534*b* through its thickness, four fixing holes 534*d* and a lateral hole 534*c* extending perpendicularly to the central hole 534*b* and through the undersized lower portion 534*a*. The second bush 537 is cylindrical in shape with a smooth hole 537*a* through its thickness along the principal axis thereof. The outside diameter of the second bush 537 is slightly larger than the central hole 536*a* in the third bush retaining plate 536.

The stationary block 538 is T-shaped with a depending lower portion 538*a* through which extends a counter bored central hole (not shown), a lateral hole 538*b* extending perpendicularly to the central hole (not shown) through the lower portion 538*a* and a pair of threaded mounting holes 538*c* in a top portion 538*d* thereof. The counter bored central hole (not shown) includes a threaded portion (not shown) on one side thereof and a smooth portion (not shown) having a larger diameter than the threaded portion (not shown).

The second moving block 539 is substantially rectangular in plan with an undersized lower portion 539*a* and includes a central hole 539*b* through its thickness and a lateral hole 539*c* extending perpendicularly to the central hole 539*b* and through the lower portion 539*a*.

The guide shaft 540 includes a smooth outer surface 540*a* with an externally threaded end 540*b* and an internally threaded end 540*c*.

The electric motor 530 is mounted within the mounting member 50 such that the threaded shaft 531 extends from the open end of the mounting member 50 toward the end wall 50*b*. The electric motor 530 is secured to the mounting member 50 by a screw 54 which extends through the mounting hole 50*g* and threadedly engages a threaded hole 54*a* in a casing 530' of the motor 530.

The threaded bush 533 is received within the central hole 534*b* of the first moving block 534 and secured against rotation by a grub screw (not shown) or other securing means. The first and second bush retaining plates 532, 535 are secured to the first moving member using screws 55 such that they retain the threaded bush 533 within the central hole 534*b* of the first moving block 534. The threaded shaft 531 is received within the threaded bush 533 for threaded engagement therewith.

The second bush 537 is received within the smooth portion (not shown) of the counter bored central hole (not shown) of the stationary block 538. The third bush retaining plate 536 is secured to the stationary block 538 to retain the second bush 537 within the stationary block 538. The externally threaded end 540*b* of the guide shaft 540 threadingly engages the threaded portion (not shown) of the counter bored central hole (not shown) of the stationary block 538. The guide shaft 540 extends through the central hole 539*b* of the second moving block 539 and is secured to the end wall 50*b* of the mounting member 50 by a screw 540*d* which extends through a washer 540*e*, through the hole 50*h* in the end wall 50*b* of the mounting member 50 and threadedly engages the internally threaded end 540*c* of the guide shaft 540. The stationary block 538 is secured to the mounting member 50 by screws 538*e* which extend through the holes 50*f* in the top wall 50*e* and threadedly engage the holes 538*c* in the stationary block 538.

Thus, rotation of the electric motor 53*a* causes the threaded shaft 53*b* to rotate, causing the first moving member 534 to translate along the threaded shaft 531. The stationary member 538 remains stationary with respect to the mounting member 50 and the second moving member 539 is free to translate along the guide shaft 540.

The first and second scissor members 51*a*, 51*b* are formed of sheet metal and each include a pair of opposed side walls 510*a*, 510*b* secured to one another in a spaced relationship by a respective upper web portion 511*a*, 511*b* and lower web portion 512*a*, 512*b*. Each side wall 510*a*, 510*b* has an upper connecting hole 513*a*, 513*b*, a lower connecting hole 514*a*, 514*b* and a linkage hole 515*a*, 515*b* upwardly spaced from the lower connecting hole 514*a*, 514*b*. Each side wall 510*b* of the second scissor member 51*b* includes an intermediate scissor hole 516*b*. Each of the opposed side walls 510*a*, 510*b* as a crank intermediate its length to provide the principal axis of each sidewall 510*a*, 510*b*, with an identical obtuse angle.

The intermediate scissor member 51*c* is also formed of sheet metal and includes a pair of opposed side walls 510*c* secured to one another in a spaced relationship by a web portion 511*c*. Each side wall 510*c* of the intermediate scissor member 51*c* has an upper connecting hole 513*c* and a lower connecting hole 514*c* adjacent its respective upper and lower ends. The intermediate scissor member 51*c* is pivotably connected to the second scissor member 51*b* by a pin 56*a*, which extends through the intermediate scissor holes 516*b* in the second scissor member 51*b* and through the lower connecting holes 514*c* in the intermediate scissor member 51*c*. The pin 56*a* is held in place with a snap ring 57*a*.

The first scissor member 51*a* is connected to the first moving block 534 by a pin 56*b*, which extends through the upper connecting holes 513*a* in the first scissor member 51*a* and through the lateral hole 534*c* in the first moving block 534. The intermediate scissor member 51*c* is connected to the stationary block 538 by a pin 56*c*, which extends through the upper connecting holes 513*c* in the intermediate scissor member 51*c* and through the lateral hole 538*b* in the stationary block 538. The second scissor member 51*b* is connected to the second moving block 539 by a pin 56*d*, which extends through the upper connecting holes 513*b* in the second scissor member 51*b* and through the lateral hole 539*c* in the second moving block 539. The pins 56*b*, 56*c*, 56*d* are held in place with a respective snap ring 57*b*, 57*c*, 57*d*.

Figure 6B:
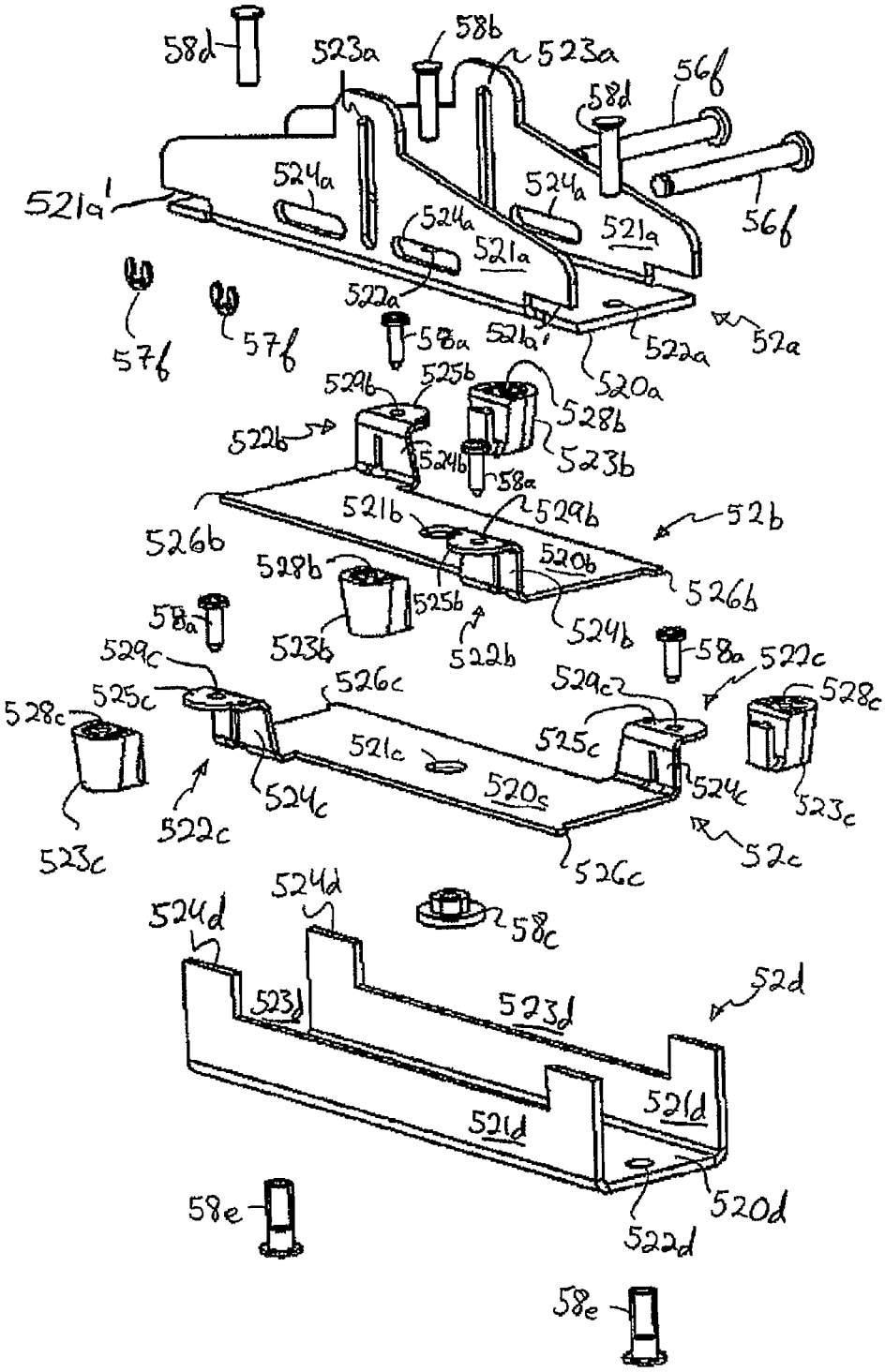
FIG. 6B is an exploded perspective view of the plunger assembly of the mechanism shown in FIGS. 4A and 5A.
Figure 7A:
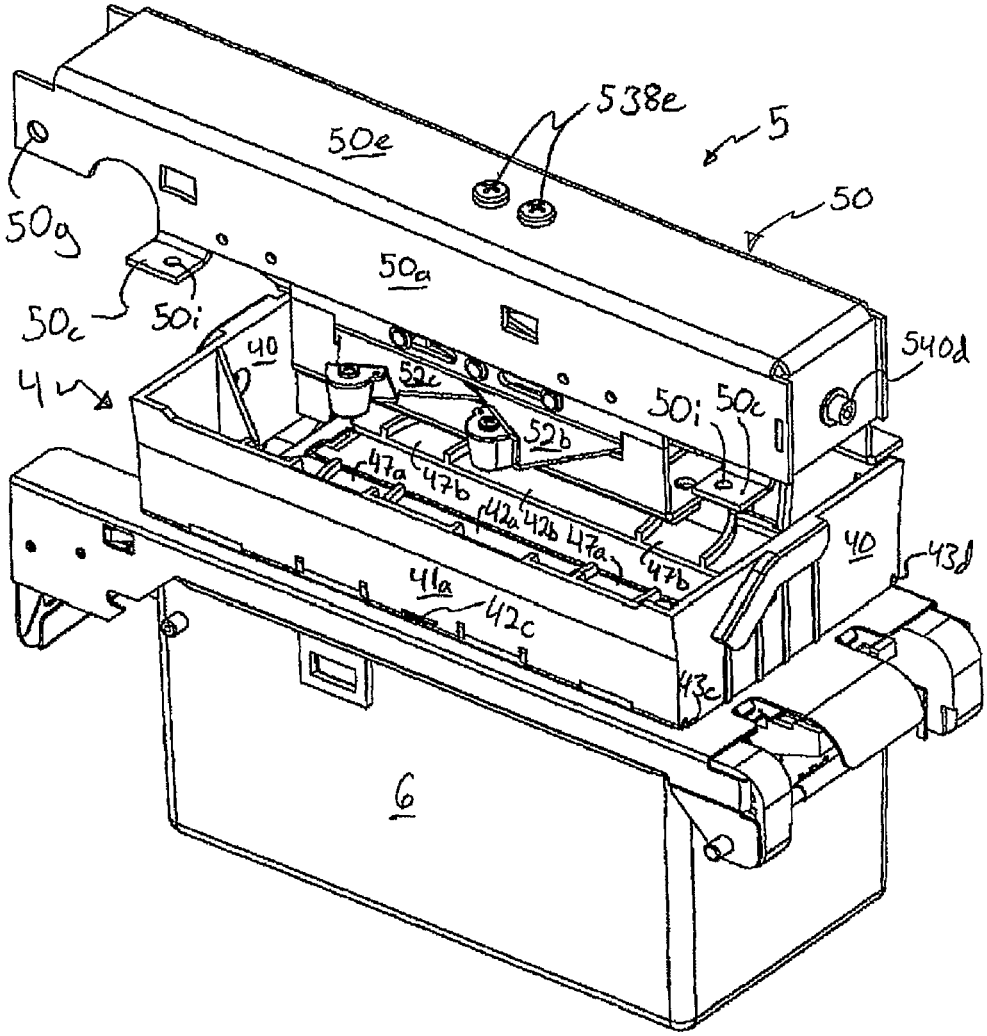
FIG. 7A shows a perspective view of the interaction of the plunger mechanism, movable container and secure container of the apparatus of FIG. 1 when the plunger is in a retracted position.
Figure 7B:
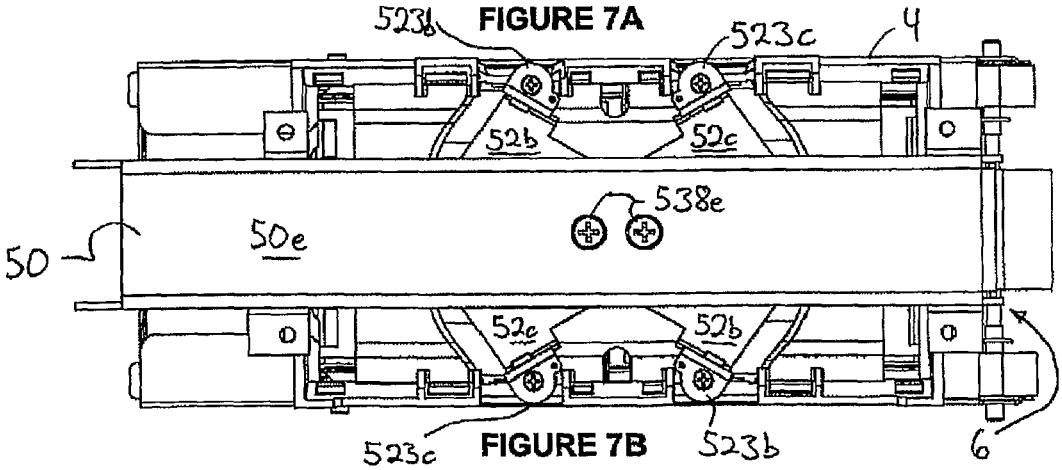
FIG. 7B is a top view of the arrangement of FIG. 7A.
Figure 8A:
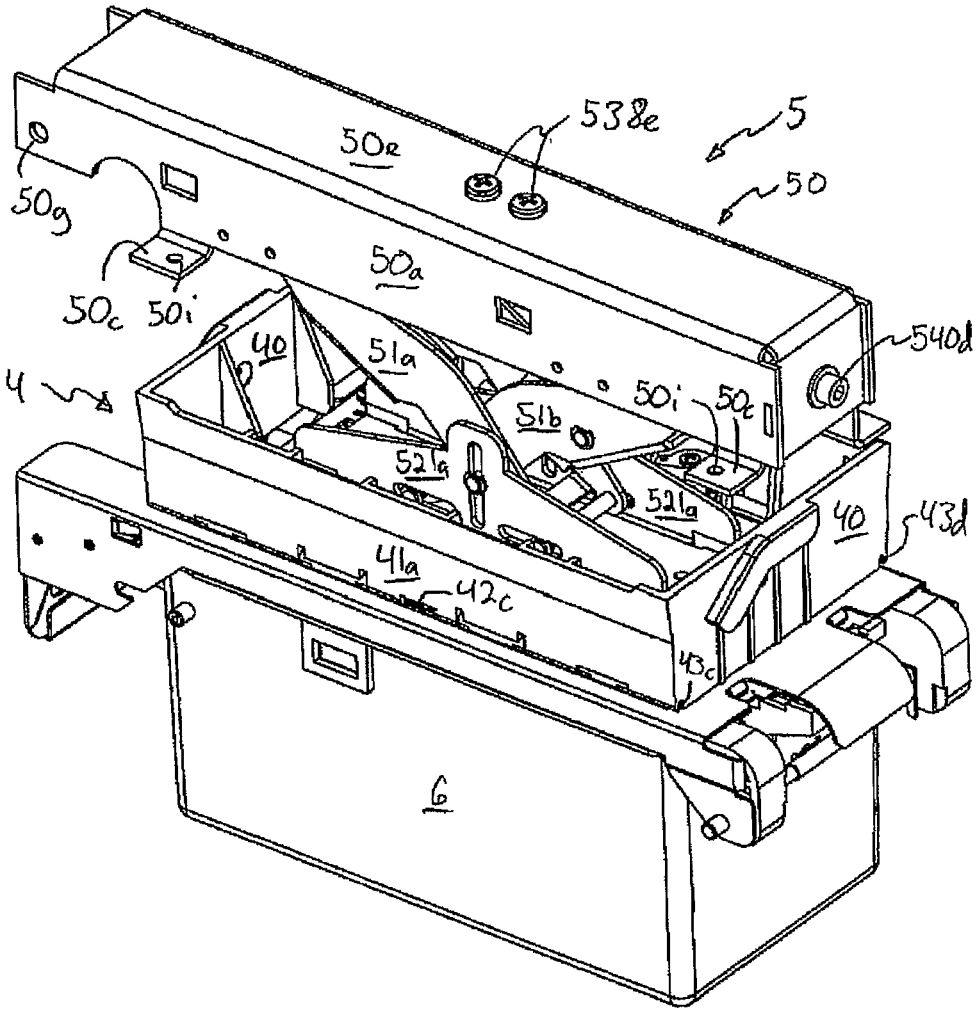
FIG. 8A shows a view similar to that of FIG. 7A but with the plunger in a partially extended position.
Figure 8B:
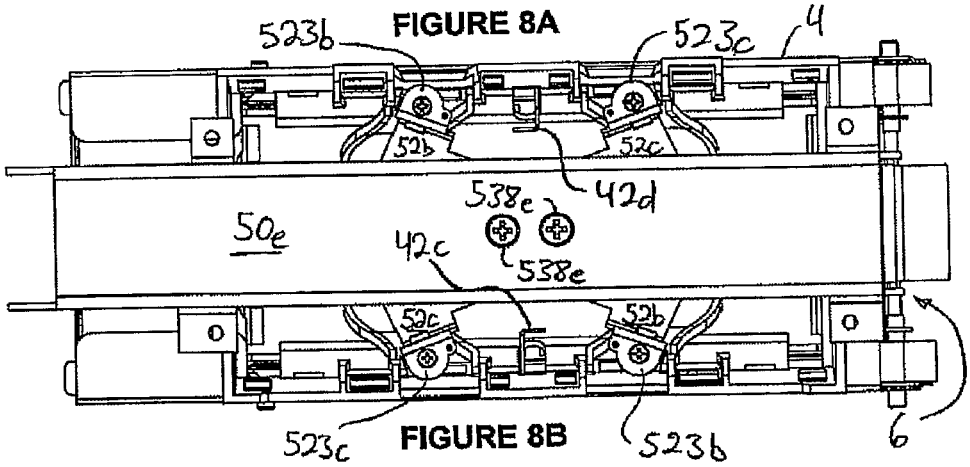
FIG. 8B is a top view of the arrangement of FIG. 8A.
Figure 9A:
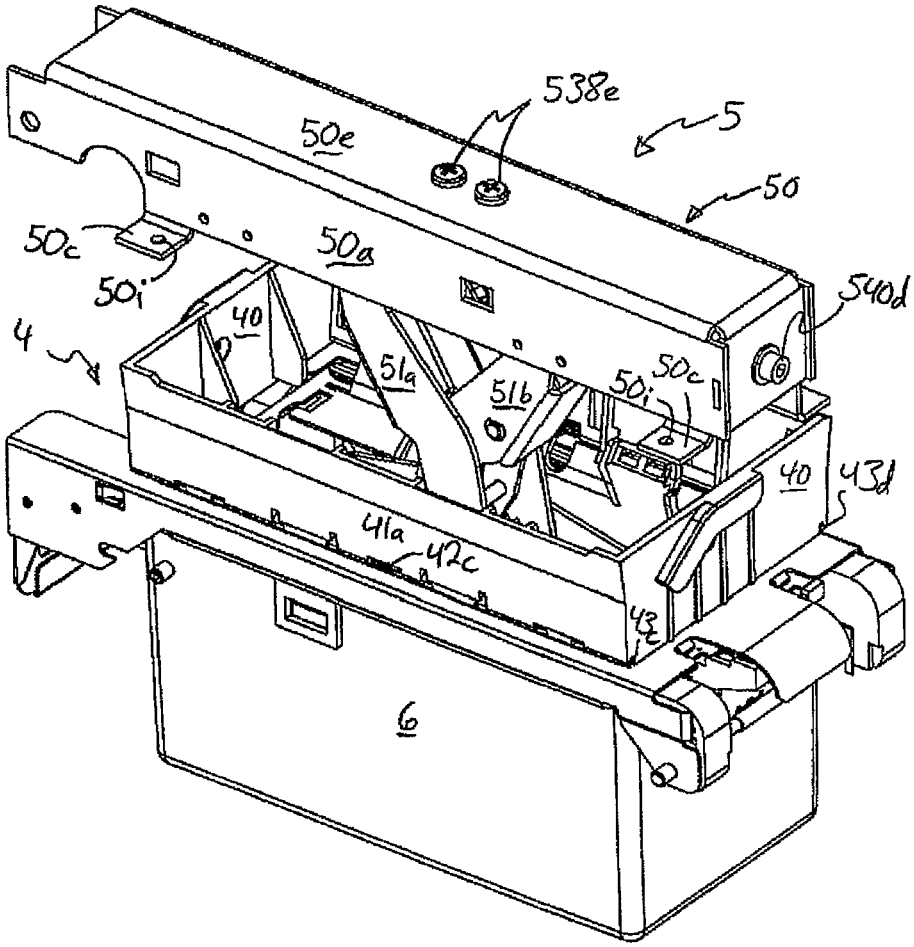
FIG. 9A shows a view similar to that of FIG. 7A but with the plunger in a fully extended position.
Figure 9B:
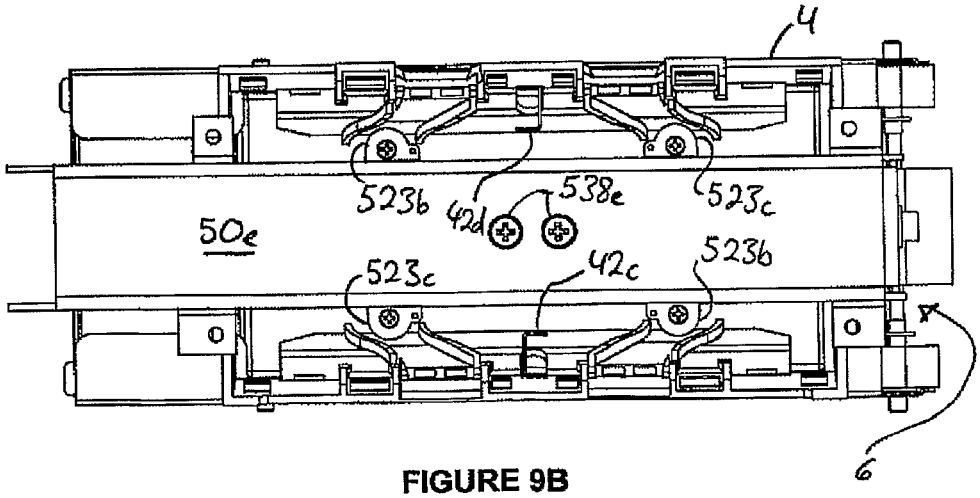
FIG. 9B is a top view of the arrangement of FIG. 9A.

Referring to FIGS. 5A and 6B, the plunger assembly 52 includes an upper plunger member 52*a*, a pair of extendable members 52*b*, 52*c* and a lower plunger member 52*d*. The upper plunger member 52*a* is formed of sheet metal and includes a substantially rectangular base 520*a* and a pair of matched upstanding substantially triangular walls 521*a* extending from the major longitudinal edges of the base 520*a*. The base 520*a* has three fixing holes 522*a* equally spaced along the longitudinal centreline thereof. Each of the walls 521*a* has a central slot 523*a*, which extends vertically, and one horizontal slot 524*a* on each side of the central slot 523*a* adjacent the bottom thereof.

The scissor members 51*a*, 51*b* are pivotably connected together such that the second member 51*b* is housed within the first scissor member 51*a* and slideably connected to the upper plunger member by a pin 56*e*, which extends through the central slot 523*a* and each of the linkage holes 515*a*, 515*b* and is held in place with a snap ring 57*e*. Each of the scissor members 51*a*, 51*b* is also slideably connected to the upper plunger member by a respective further pin 56*f*, which extends through one of the respective horizontal slots 524*a* and through the lower connecting holes 514*a*, 514*b* in the relevant scissor member 51*a*, 51*b* and is held in place with a snap ring 57*f*.

Each extendable member 52*b*, 52*c* has a substantially rectangular base 520*b*, 520*c* with a central hole 521*b*, 521*c*, a pair of spring catches 526*b*, 526*c* and a pair of upstanding feet 522*b*, 522*c* which carry a respective semi-cylindrical contact member 523*b*, 523*c*. The spring catches 526*b*, 526*c* extend from opposite longitudinal edges at opposite ends of the base 520*b*, 520*c*. The feet 522*b*, 522*c* each include an upstanding portion 524*b*, 524*c* and an outwardly extending semi-circular portion 525*b*, 525*c* and extend from opposite longitudinal edges at opposite ends of the base 520*b*, 520*c*. Each contact member 523*b*, 523*c* has a central threaded bore 528*b*, 528*c* and is secured to a respective foot 522*b*, 522*c* by a screw 58*a* which extends through a central hole 529*b*, 529*c* in the relevant semi-circular portion 525*b*, 525*c* and threadedly engages the bore 528*b*, 528*c* in the contact member 523*b*, 523*c*.

The lower plunger member 52*d* is also formed of sheet metal and includes a substantially rectangular base 520*d* and two upstanding walls 521*d* extending from the longitudinal edges of the base 520*d*. The base 520*d* has two fixing holes 522*d* which correspond in location to the outermost holes 522*a* in the base 520*a* of the upper plunger member 52*a*. Each of the upstanding walls includes a central recess 523*d* in the upper free edge thereof to provide a pair of matched castellations 524*d*.

The upper plunger member 52*a*, extendable members 52*b*, 52*c* and lower plunger member 52*d* are connected together by a screw 58*b* which extends through the middle fixing hole 522*a* in the upper plunger member 52*a*, the central holes 521*b*, 521*c* in the extendable members 52*b*, 52*c* threadedly engages a nut 58*c*. A further pin 58*d* extends through each of the outermost fixing holes 522*a*, 522*d* of the upper and lower plunger members 52*a*, 52*c* and threadedly engages a respective nut 58*e*, thereby fixing the upper and lower plunger members 52*a*, 52*d* relative to one another such that the castellations 524*d* engage the free ends 521*a*' of the triangular walls 521*a* of the upper member 52*a*. The extendable members 52*b*, 52*c* are free to pivot relative to the upper 52*a* and lower 52*d* members such that the contact members 523*c* can reciprocate towards and from the recess 523*d*. A spring (not shown) is secured to opposed spring catches 526*a*, 526*b* of the extendable members 52*b*, 52*c* such that they are biased towards an extended condition, as shown in FIG. 4A.

In use, a casino dealer (not shown) receives currency (not shown) from a punter or customer (not shown) and places it on the ramp portion 20*b* adjacent the inlet 30 of the cash counter 3. The currency (not shown) is then fed through the inlet 30, counted and transferred through the outlet 31 thereof into the gap or space between adjacent finger members 26*a* of the transfer wheel 26. The value of the counted currency (not shown) is displayed on the counter screen 32.

As will be best appreciated in relation to FIG. 10, as the transfer wheel 26 rotates, the currency (not shown) is transported until its lower edge contacts the ridges 45*b* of the side wall 41*b* of the movable container 4, where continued rotation of the transfer wheel 26 causes the currency (not shown) to exit the space between adjacent finger members 26*a* and fall into an aligned position within the movable container 4. The fingers 26*a* of the transfer wheel 26 are pulled through the recesses 44*c* in the container 4. Because the movable container 4 is tilted, i.e. the base flaps 42*a*, 42*b* are inclined to the horizontal in the loading position (see FIG. 3A) the currency or other documents placed therein will naturally stack against the lowermost wall 41*b* (as seen in FIG. 3A) by the action of the transfer wheel 26 deposit and gravity. This has the effect of providing a very neatly stacked bundle of currency for subsequent use. It will be appreciated that the speed of the transfer wheel 26 may be adjusted to suit the size and shape of the documents (not shown).

The movable container 4, containing the counted currency (not shown), is then automatically moved by the conveyor 24 to the intermediate or escrow position (FIG. 3B), at which point the container 4 and the enclosed stack of documents is in sight of the punter or customer (not shown) by virtue of the transparent first access door 20. The punter or customer (not shown) then either accepts or rejects the value of the counted currency (not shown) displayed on the display screen 32.

Figure 3B:
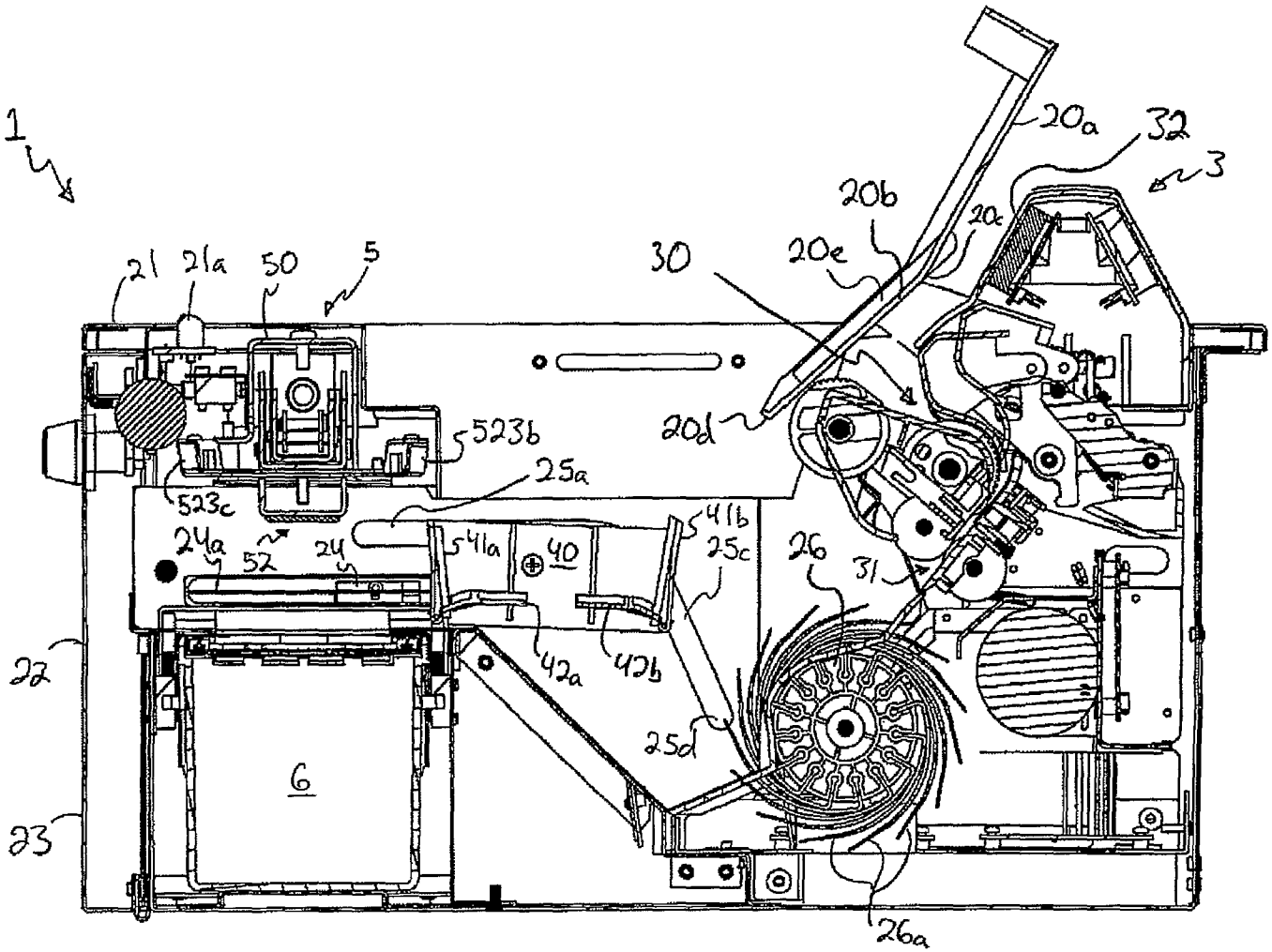
FIG. 3B is a section view along line A-A of FIG. 2 showing the movable container in a second, intermediate or escrow position with the first access door in an open condition.
Figure 3C:
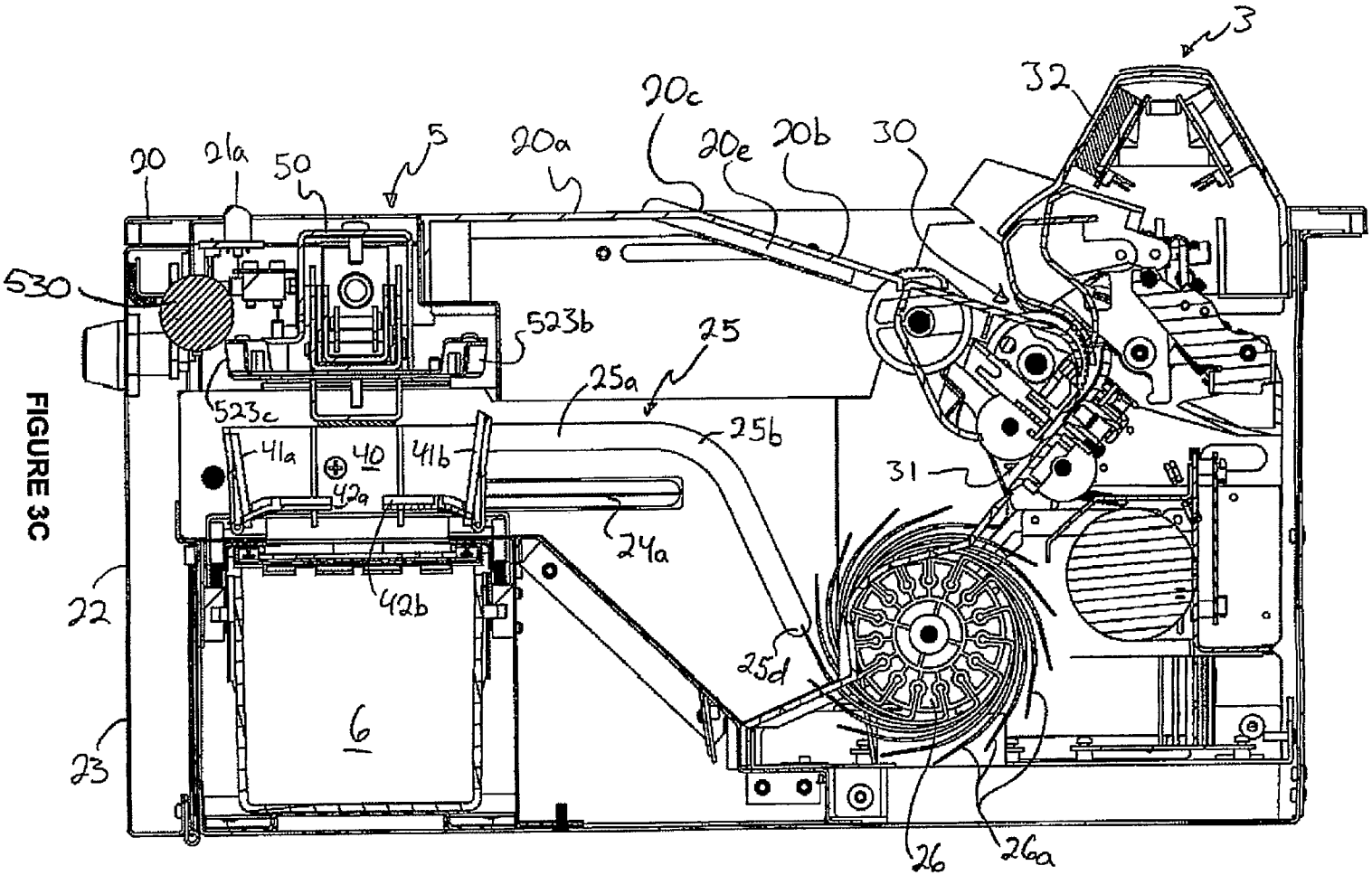
FIG. 3C is a section view along line A-A of FIG. 2 showing the movable container in a third, deposit or drop position.

If the count is rejected, the first access door 20 is opened (as shown in FIG. 3B) by pressing the rejection push button 21*b* and pivoting the door 20 about a hinge (not shown), thereby providing access to the currency (not shown). Alternatively, the container 4, or the documents located therein, may be raised up beyond the top of the housing 2 by mechanical or other means.

If the count is accepted, the acceptance push button 21*a* is pressed to approve the count, which results in the movable container 4 being moved to the drop position by the conveyor 24.

When the movable container 4, containing the approved currency (not shown), is in the drop position (FIG. 3C), it is no longer accessible by the user(s) of the apparatus 1. In this embodiment, when the movable container 4 reaches the drop position, the plunger mechanism 5 automatically moves from a retracted position to an extended position to urge the currency into the securable container 6.

However, the apparatus 1 may be configured such that the user depresses a plunger actuation button (not shown) to activate the plunger mechanism 5. In such a case, the housing 2 preferably comprises internal walls (not shown) which cooperate with the movable container 4 to prevent access to the contents thereof, for example through the first access door 20.

Referring now to FIGS. 7A to 9B, when the plunger mechanism 5 is in a fully retracted position, the scissor members 51*a*, 51*b* are substantially within the housing member 50 and the extendable members 52*b*, 52*c* are biased towards the fully extended condition. The motor 530 of the actuator assembly 53 causes the threaded shaft 531 to rotate, thereby causing the first moving member 534 to translate and urge the end of first scissor member 51*a* towards the stationary member 538. Because the scissor members 51*a*, 51*b* are pivotally coupled via pin 56*e*, driving the scissor member 51*a*, causes the upper end of scissor member 51*b* to be driven towards the stationary member 538, bringing the upper ends of the scissor members 51*a*, 51*b* toward one another. This in turn causes the plunger assembly 52 to move downwardly away from the mounting member 50, the pins 56*f* sliding in slots 524*a* to retain the lower ends of the scissor members 51*a*, 51*b*.

As the plunger assembly 52 is urged downwardly, the contact members 523*b*, 523*c* of the extendable members 52*b*, 52*c* enter the guide channels 44*a*, 44*b* in the side walls 42*a*, 42*b* of the movable container 4. As a result of the angle of the side walls 42*a*, 42*b*, the extendable members 52*b*, 52*c* are urged toward their retracted position. Continued movement of the plunger assembly 52 causes the extendable members 52*b*, 52*c* to contact the edges of the currency (not shown) contained within the movable container 4 and urge the base flaps 42*a*, 42*b* toward their open (i.e. downwardly extending) condition.

As this occurs, the contact members 523*b*, 523*c* enter the guide channels 47*a*, 47*b* in the base flaps 42*a*, 42*b* and the extendable members 52*b*, 52*c* are further urged toward their retracted position. The curved shape of the guide channels 47*a*, 47*b* allows the contact members 523*b*, 523*c* to remain therein while the extendable members 52*b*, 52*c* are further urged to their retracted position. As the currency remains inwardly of the ridges 45*a*, 45*b*, 48*a*, 48*b*, this effectively sweeps or wipes the side walls 42*a*, 42*b* of the movable container 4, thus ensuring that no currency (not shown) remains therein.

Continued extension of the plunger assembly 52 forces the currency into a secureable container 6, the container 6 may be provided with a pouch as described in WO 2008/114038, in which case, the plunger assembly 52 is arranged to be able to plunge the documents beyond the flaps of the pouch and whereby the documents are retained in the pouch. Of course, other securable containers and systems may be used.

After the currency (not shown) has been transferred into the securable container 6, the plunger assembly 52 is retracted, which causes the extendable members 52*b*, 52*c* and the base flaps 42*a*, 42*b* to return to an extended position by virtue of their respective spring mechanisms 42*c*, 42*d*. The plunger assembly 52 is brought out of cooperation with the container 4 and the movable container 4 is then returned to the loading position and the above process may be repeated as required.

In order to remove the securable container 6 from the apparatus 1, for example after closure of the casino, the key lock mechanism 27*b* of the third access door 27*a* is unlocked and the third access door 22 is opened. Internal walls (not shown) of the housing 2 cooperate with the movable container when it is in the drop position to prevent access to the contents of the securable container 6, which is itself locked into place.

In one embodiment, a cover plate (not shown) is slid through channels (not shown) on opposite sides of the container 6 to close the enclosure. As the cover plate (not shown) is moved into place, a tongue (not shown) at the leading end thereof having saw-tooth formations (not shown) enters a hollow formation (not shown) at the trailing end of the container 6, thereby releasing the aforementioned lock. The saw-tooth formations (not shown) engage with the interior of the hollow formation, for example with corresponding formations (not shown), thereby preventing removal of the cover plate (not shown) from the securable container 6. The container 6 is thereby secured prior to removal and access thereto is prevented without destruction thereof.

Several variations to the embodiment disclosed herein are envisaged without departing from the scope of the invention. For example, the extendable portions 52*b*, 52*c* need not contact or even cooperate with the movable container and/or they may be linearly movable as opposed to rotatable with respect to the lower plunger member 52*d*.

The actuator mechanism 53 may be replaced with a simple actuation means, for example such as a hydraulic or pneumatic cylinder or a rack and pinion arrangement.

Additionally or alternatively, the bushes 533, 537 and bush retaining plates 532, 535, 536 may be omitted with the threaded hole 533*a* and smooth hole 537*a* being formed directly in the first moving member 534 and stationary member 538 respectively. Two or more components of the actuator mechanism 53 may be formed integrally with one another, for example the guide shaft 540 may be formed integrally with the stationary block 538.

Furthermore, the movable container 4 may be replaced with any suitable means capable of transferring currency. For example, the transfer means may comprise a conveyor such as a pair of separated conveyor belts which may be made of resilient material, wherein the currency may be supported on the conveyor and movable between the requisite positions. The plunger mechanism 5 may be arranged to urge the currency between the conveyor belts.

The transfer wheel 26 need not include finger members 26*a* and/or the finger members 26*a* may be replaced with any means capable of transferring the currency from the outlet 31 to the movable container 4. In fact, the transfer means need not even include a transfer wheel 26.

A further cover member may be provided to engage the container 4 or the contents thereof as it moves from the loading position (see FIG. 3A) to the ESCROW position (see FIG. 3B). The cover member may help to retain the documents contained within the container 4. The cover member may include document engagement means to engage (e.g.

grip) documents located within the container 4. As the container 4 moves to the ESCROW position the cover member may be moved aside to allow access to the documents or the cover member may be lifted out of or towards the top of the apparatus to allow a customer access to their deposited documents (e.g. money). The cover to member may remain in the ESCROW position whilst documents move in the container to the deposit position (see FIG. 3C). The cover member may follow or otherwise move back to the loading position to engage the container 4 in the next iteration of the process. It will be preferable that the cover member is transparent.

Figure 11:
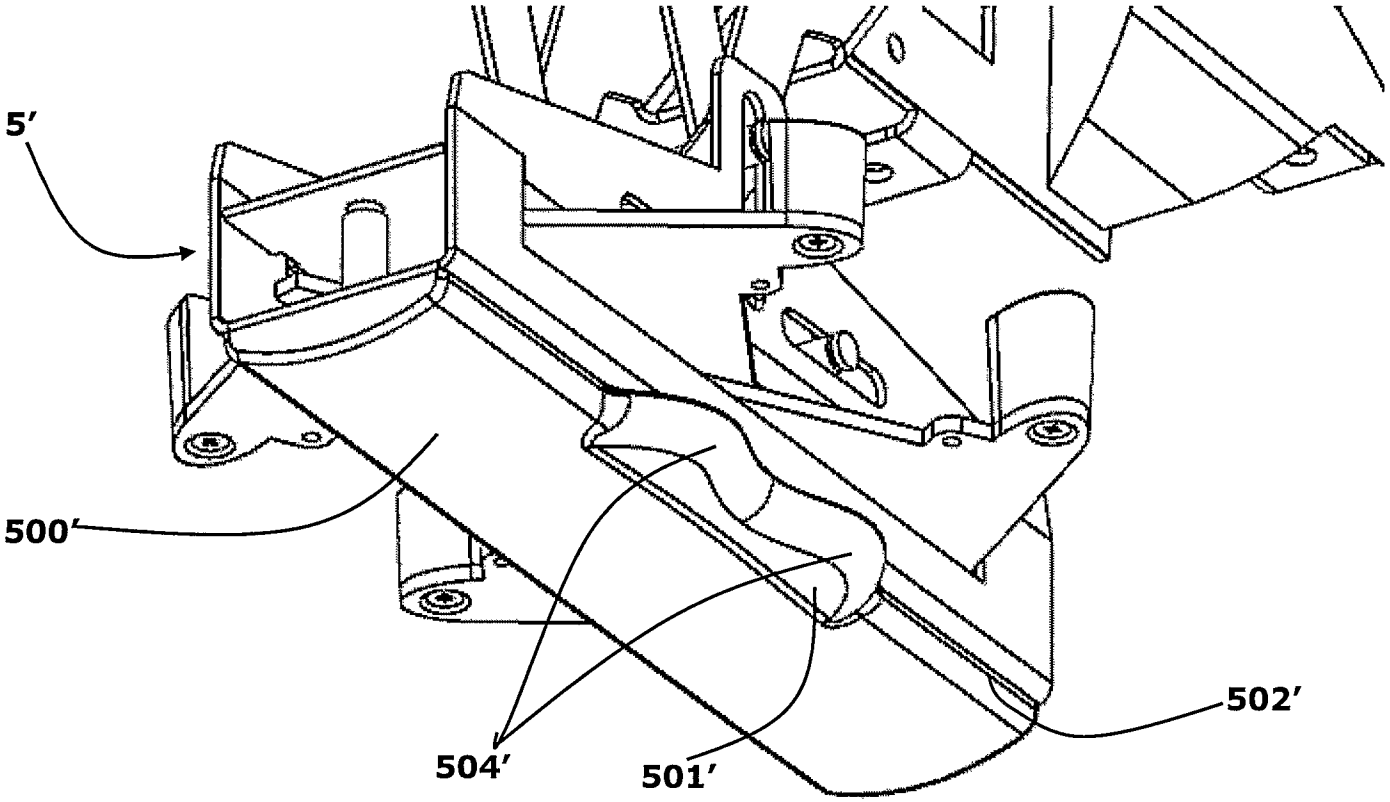
FIG. 11 is a perspective view of a further embodiment of plunger of the invention.

As shown in FIG. 11 there is a further embodiment of plunger 5' in which most elements are the same as described in relation to FIGS. 4 to 9 above and so will not be repeated. In distinction to the previously described plunger 5, the plunger 5' has a curved plunging surface 500' and a note guide means 501' located on the leading edge 502' of the plunger 5'. The guide means 501' is a curved body with a pair of protuberances 504'. The curved plunging surface 500' and guide means 501' help to ensure that crumpled or folded notes are properly plunged into the secure container. For instance, notes which have been folded can retain their shape even after having been counted. Such folded notes can cause problems which depositing notes using a plunger or other mechanism.

Figure 12:
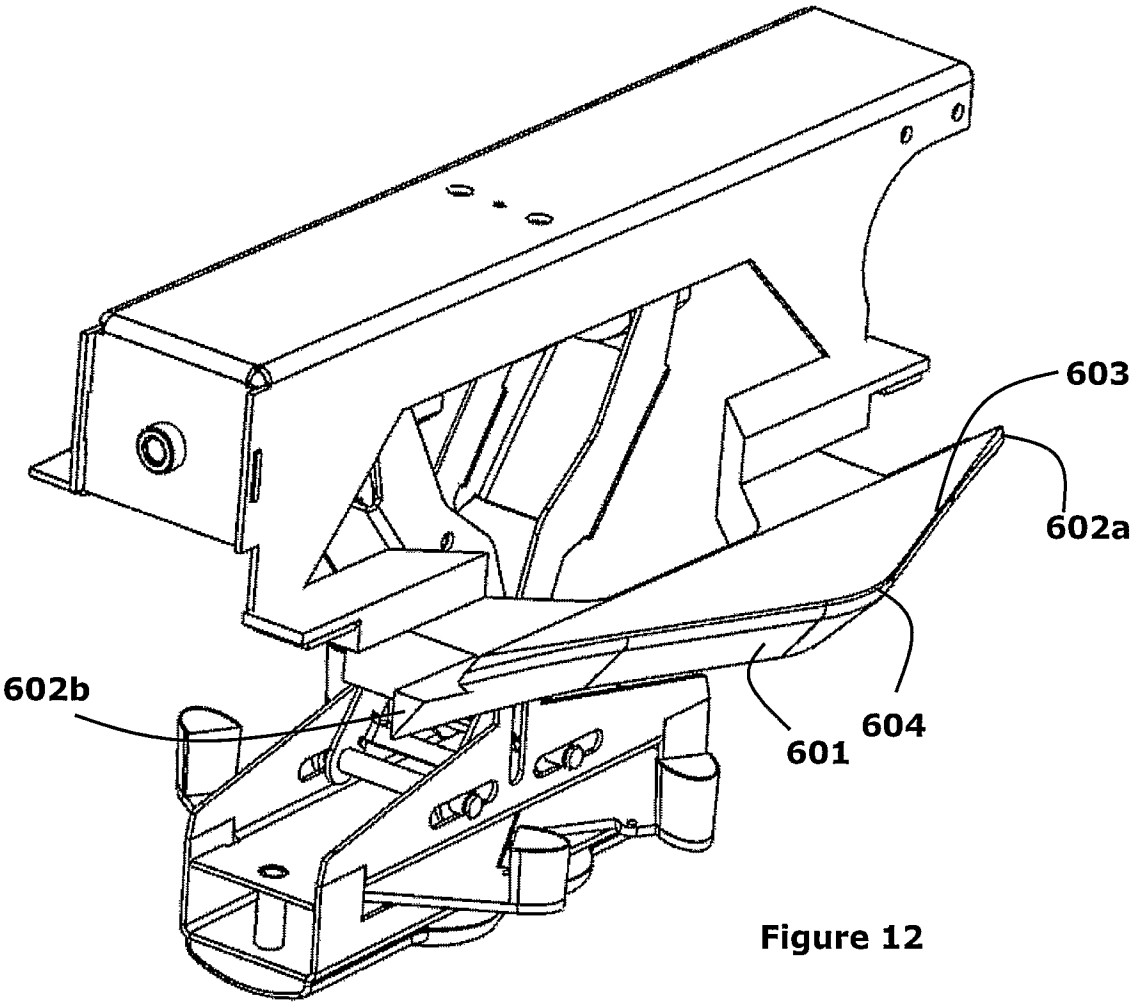
FIG. 12 is a perspective view of a further embodiment of the apparatus of the invention.

FIG. 12 shows a further note guide 600 which is upstream of the plunger mechanism 5', that is the container 4 passes first under the note guide 600 and then to the deposition position for engagement of the plunger 5, 5' with the documents in the container 4. The guide 600 is of pointed and slanted configuration, which is to say that it has a leading face 601 having a top edge 603 which converges from its ends 602*a*, 602*b* at a smooth apex 604 midway along its length. The face 601 slants away from the top edge in the direction of passage of the container 4, thereby providing an undercut smooth face 601.

If a document protrudes above the top of the container 4, it will be engaged by the face 601 of the guide 600 and forced into the container 4. The shape of the guide face is such as to ensure that protruding documents are located within the container 4 when the container moves into the plunge position. In such a case, the note guide means 501' also helps to ensure that the notes do not protrude above the container 4 as the container 4 moves into the plunge position.

The plunger mechanism 5 need not include extendable members 52*b*, 52*c* or the extendable members 52*b*, 52*c* may be replaced with any other suitable wiping means, for example contact members 523*b*, 523*c* may be linearly movable between extended and retracted positions and may be urged to the extended condition by biasing means such as a spring mechanism. Additionally or alternatively, the scissor members 51*a*, 51*b*, 51*c* may be replaced with any suitable means for inducing movement of the plunger assembly 52, for example a hydraulic piston. The plunger mechanism 5 does not require a mounting member 50, for example it may be mounted directly to the housing 2.

In certain other embodiments, it is envisaged that the apparatus may further comprise means for displaying the value of currency transferred to a particular securable container. Such means may comprise, inter alia, a means for printing information onto the securable container itself, or a database combined with a means for identifying a given container. Alternatively, a note of the amount within the container may be placed therein automatically.

In preferred embodiments, the securable containers are suitable for introduction to a cash-in-transit system.

Any of the features disclosed herein may be omitted and/or replaced with similar means able to perform the requisite task and/or any combination of any of the features disclosed herein is envisaged without departing from the scope of the invention.

While the invention has been described in detail and with reference to specific embodiments thereof, it will be apparent to one skilled in the art that various changes and modifications can be made therein without departing from the spirit and scope thereof.

The invention claimed is:

1. An apparatus for handling documents comprising:

an inlet for receiving documents;

a transfer means for transferring documents from said inlet to a secure, or securable, location, wherein said transfer means is operable, in use, to transfer documents between said inlet and a deposit position adjacent the securable location;

deposit means, for urging, in use, documents located at a deposit position into said secure or securable location, said deposit means comprising one or more extendable portions arranged to move between an extended and a contracted position as said deposit means urges documents into said secure or securable location;

wherein said transfer means further comprises a movable container for holding documents;

wherein said movable container comprises a cooperating portion wherein said cooperating portion comprises a portion of one or more side walls and a movable portion of the base, for cooperating with said one or more extendable portions; and wherein said cooperating portion of said movable container comprises guide means that include grooves or ridges on an internal surface of said movable container.

2. The apparatus according to claim 1, wherein said transfer means further comprises a movable container for holding the documents.

3. The apparatus according to claim 1, wherein one or more extendable portions comprise one or more plates which comprise one or more contact members.

4. The apparatus according to claim 3 wherein said one or more plates comprises wiper blades.

5. The apparatus according to claim 1, wherein said one or more extendable portions are movable relative to a plunger in a scissor arrangement.

6. The apparatus according to claim 1, wherein each extendable portion comprises a cooperating portion that includes a protruding portion or contact member, which cooperates, in use, with said guide means.

7. The apparatus according to claim 6, wherein each extendable portion cooperates, in use, with said guide means such that relative movement between said plunger and said movable container causes each extendable portion to move, relative to said plunger.

8. The apparatus according to claim 7 wherein said movable container causes each extendable portion to rotate relative to said plunger.

9. The apparatus according to claim 7, wherein each extendable portion cooperates, in use, with said guide means such that movement of said plunger relative to said movable container causes each extendable portion to move from a first position toward a second position.

10. The apparatus of claim 9 wherein said first position is an extended position and said second position is a stowed position.

11. The apparatus according to claim 1, wherein said deposit means has a curved document engaging surface.

12. The apparatus according to claim 1, further comprising a document guide upstream of said deposit means to aid in document presentation to said deposit means.

* * * * *